US005381973A

United States Patent [19]

Hemesath

[11] Patent Number: 5,381,973

[45] Date of Patent: Jan. 17, 1995

[54] ROTOR FOR IMPACT CRUSHES OR HAMMER MILLS

[75] Inventor: Gerhard Hemesath, Havixbeck, Germany

[73] Assignee: Noell Service und Maschinentechnik GmbH, Langenhagen, Germany

[21] Appl. No.: 935,814

[22] Filed: Aug. 26, 1992

[51] Int. Cl.[6] ..... B02C 13/04

[52] U.S. Cl. ..... 241/191; 241/194

[58] Field of Search ..... 241/191, 194; 228/140, 228/177, 189; 29/889, 889.6

[56] References Cited

U.S. PATENT DOCUMENTS

| | | | |
|---|---|---|---|
| 3,098,614 | 7/1963 | Meyer | 241/193 |
| 3,123,702 | 3/1964 | Hemesath . | |
| 3,531,055 | 9/1970 | Alt | 241/192 |

FOREIGN PATENT DOCUMENTS

| | | |
|---|---|---|
| 0019542 | 11/1980 | European Pat. Off. . |
| 0444432 | 2/1991 | European Pat. Off. . |
| 1589790 | 5/1970 | France . |
| 2314996 | 1/1977 | France . |
| 2356472 | 1/1978 | France . |
| 6601200 | 12/1965 | Germany . |
| 1808322 | 4/1973 | Germany . |
| 8214553 | 10/1985 | Germany . |
| 3522643 | 1/1987 | Germany . |

*Primary Examiner*—Mark Rosenbaum
*Assistant Examiner*—John M. Husar
*Attorney, Agent, or Firm*—Horst M. Kasper

[57] ABSTRACT

A rotor (1) for impact or hammer mills is formed out of several rotor disks (1) made of cast steel and welded together, where the rotor disks exhibit hubs (3) contacting each other at annular sections representing the longest extension of the rotors in an axial direction. The rotor disks are connected to each other by annular weld seams at the hubs. According to a further embodiment of this rotor, the turn-outs (17), furnished for the weld seams (9) at the front faces of the hubs (3), extend from the outer edges over a substantial part of the radial thickness of the hubs, and the weld seam grooves (16), formed by the turn-outs of the neighboring rotor disks, are filled with welding materials.

6 Claims, 8 Drawing Sheets

ROTOR FOR IMPACT CRUSHES OR HAMMER MILLS

BACKGROUND OF THE INVENTION

1. Field of the Invention

The invention relates to rotor mills or impact crushers, where a rotor comprises several rotor disks made of cast steel, where the rotor disks are welded together when employed in connection with impact crushers or hammer mills, where the rotors are advantageously utilized in machines for comminuting coal, rock, or other materials.

2. Brief Description of the Background of the Invention Including Prior Art

It is known to assemble a rotor for use in an impact crusher or hammer mill from two or more metallic rotor disks which are welded to each other and have central portions or hubs serving to receive torque from a shaft. Neighboring disks are welded to each other at their peripheries, i.e., radially outwardly of the respective hubs. Reference may be had, for example, to U.S. Pat. No. 3,098,614 and to German Utility Model No. 66 01 200. Welded seams are desirable and advantageous because they lend the necessary rigidity and stability to the assembled rotor.

A drawback of welded seams which are provided at the periphery of a conventional rotor for use in a hammer mill. is that the seams are necessarily interrupted, i.e., such seams can be said to constitute relatively small portions of circumferentially complete annuli because they are interrupted in the regions of the hammers. The same holds true for the conventional rotors of impact crushers. In addition, the welding operation which involves bonding together two or more disks to form the rotor of an impact crusher takes up much time and is complex and expensive. A further drawback of conventional rotors for use in hammer mills or impact crushers is that their interrupted welded seams are located at the periphery and are thus subject to much wear and tear as a result of contact with material which is being comminuted.

The German printed Patent document laid open No. 1,808,322 discloses a rotor with circular disks having radially innermost portions welded to a drum which serves as a shaft. However, each disk is a composite structure which is assembled of several sectors and such sectors are offset relative to each other in the axial direction of the rotor. Thus, the connections between the composite disks and the shaft are not annular welded seams but rather mere fragments or small portions of ring-shaped seams. Moreover, the bonding of sectors to the shaft is a complex and time-consuming operation and the assembled rotor is often unsatisfactory due .to unacceptable eccentricity of its components. Still further, it is necessary to provide two sets of welded seams for each disk which is part of the rotor in the aforementioned Patent document.

Annular ring welding seams are furnished at the outer edges of the front faces of the hubs, in particular, in the case of large rotors as they are employed in primary breakers in view of the beat and shock loads occurring during the operation of such breakers. Annular ring welding seams disposed at the outer edges of rotors may not show the necessary strength.

The assignee of the present application has filed another application on Feb. 28, 1991 bearing Ser. No. 07/662,009 relating to a similar subject and giving details relating to problems associated with this field.

Assignee's copending application, Ser. No. 07/662,009 teaches that at least one welding seam is preferably located at outer edges of peripheral surfaces of hubs provided at rotor disks.

SUMMARY OF THE INVENTION

1. Purposes of the Invention

It is an object of the invention is to provide a novel and improved rotor for use in comminuting or crushing machines where the rotor is constructed and assembled in such a way that the connections between neighboring components of the rotor are shielded from material which is being comminuted.

It is another object of the invention to provide novel and improved connections between the hubs of disks constituting a rotor of a hammer mill or impact crusher.

It is a further object of the invention to provide novel and improved disks for use in connection with rotors subjected to heavy impact loads.

It is an additional object of the invention to provide a novel and improved composite hub for the above outlined rotor.

Still another object of the invention is to provide a novel and improved method of bonding neighboring metallic disks of a rotor to each other in a time-saving and inexpensive way.

It is yet a further object of the invention to provide an impact crusher which embodies a rotor of the above outlined character.

Another object of the invention is to provide a hammer mill which embodies the above outlined rotor.

An additional object of the invention is to provide novel and improved means for mechanically and integrally connecting the hubs of disks in a rotor for use in a crushing or comminuting machine, such as a hammer mill or an impact crusher.

Still another object of the present invention is to provide an improved assembly of the machine which is associated with simplification of maintenance and assembly work.

These and other objects and advantages of the present invention will become evident from the description which follows.

2. Brief Description of the Invention

According to the present invention, there is provided for a method for the production of a rotor comprising the following steps. Groove sections are formed in hubs combined with rotor disks for accepting a weld seam. Recesses are formed at axial ends of hubs from inside for accepting positioning elements. The rotor disks are superposed onto each other. The rotor disks are centered relative to each other with the aid of annular disks fitting into the recesses and with the aid of a tube inserted into the annular disks. The rotor disks are aligned relative to each other by rotating around the annular disks in circumferential direction. The rotor disks are provisionally connected by welding points. The tube is inserted into the annular disks. The tube projects over the two ends of the unit formed by the provisionally interconnected rotor disks. The unit formed by the rotor disks is placed with ends of the tube onto two roller pairs of a welding platform. The unit formed by the rotor disks is slowly rotated by a drive device mounted on said welding platform under the welding apparatus. A gun of said welding apparatus reaches in between the rotor disks up to the hubs and the weld seam groove.

Recesses can be formed at axial ends of hubs from inside with match-fitting precise cylindrical turn-outs.

The rotor disks can be provisionally connected from the outside by welding points placed into the base of the grooves formed by the groove sections and furnished for the weld seams. The rotor disks can be provisionally connected by welding points from the inside at positions accessible through the edge cut-outs of the annular disks.

The annular disks can be removed after the rotor disks are provisionally connected. Annular weld seams can be generated at an abutting position of the neighboring hubs from the inside. The two outer annular disks can then be reinserted.

The rotor disks can be heated to temperatures of between about 125° and 250° C. depending on the material composition of the rotor disks in a preheating furnace before the provisional connection by the welding points. The unit comprised of the rotor disks is advantageously preheated to this temperature before the production of the weld seams with the aid of flame tubes throwing flames, whereby this temperature can be maintained during the welding process.

A weld seam layer can be applied to the groove during a rotation of the unit. The position of the gun can be automatically reset during each rotation by the thickness of a weld seam layer generated.

A rotor for impact or hammer mills comprises a unit including a plurality of rotor disks. The rotor disks have hubs of differing widths and are made of cast steel. Groove sections are furnished at the front faces of the hubs, The groove sections extend from the outer edges over a substantial part of the radial thickness of the hubs for an accommodation of weld seams. The rotor disks are axially aligned relative to one axis. The rotor disks are sequentially disposed along said axis. The hubs of differing widths of neighboring rotor disks contact each other. The groove sections at neighboring rotor disks form weld seam grooves. The weld seam grooves are filled with weld seams. The rotor disks are connected to each other by annular weld seams attaching neighboring hubs to each other.

The weld seams can comprise several layers of welded metal disposed in a radial outward direction on top of each other.

The present invention provides a corresponding strengthening of the welding seams and of the connections between the neighboring rotor disks. Turned-out areas, provided for the welding seams at the front faces of the hubs, are extending from the outer edges over a substantial part of the radial thickness of the hubs. The weld seam grooves are filled with welding material, including welding powder. The welding powder, which is to prevent primarily oxidation during the welding and also serves as flux agent, covers the weld formation. It has to be prevented during the welding process that oxygen reaches the welding material during formation of the weld. Excessive welding material is suctioned off. The welding powder is molten during the welding operation and forms a slag, which breaks off again during the rotation of the rotor based on cooling.

The production of the welding seams, exhibiting under certain circumstances a large thickness, can be performed in various ways. It is most advantageous to do this by forming the welding seams from several layers successively applied on top of each other. For this purpose, the centered rotor disks, aligned in circumferential direction and tensioned to each other, are slowly and repeatedly rotated in horizontal axle position under the fixedly disposed welding apparatus. The welding apparatus reaches up to the hubs or in between the provided turned out areas, and a second welding seam is applied onto a first welding seam until the grooves are filled with welding material in the base of the grooves, formed by in each case two grooves or turn-outs. This can occur simultaneously in all grooves of a rotor in case of a presence of a number of guns of the welding apparatus, which number corresponds to the number of grooves. If the welding apparatus is furnished with an automatic welding wire feed, and if the gun of the welding apparatus is automatically moved back by a distance corresponding to the thickness of the welding seams after each rotor rotation, then the welding seams can be produced with a minimum of labor and time expenditure, even though the number of the layers in case of large rotors can amount to 50 and more, and the overall length of the welding seams thereby generated in the individual grooves can amount to about 100 meters.

The depth of the grooves has of course to be selected such that annular ribs with corresponding front faces still remain at the hubs, where said hubs adjoin and are resting with the front faces disposed perpendicular to the hub axis against each other upon tensioning and pulling together of the rotor disks.

These ribs can possibly melt away during the welding process such that in certain circumstances the hubs are then welded together over the complete front face, wherein the ribs are provided close to the inner edges of the front faces.

The rotor disks have to be exactly and precisely centered relative to each other during the tensioning together. Furthermore, they have to be aligned relative to each other in circumferential direction, such that the edge cut-outs, furnished in the rotor disks, are completely and precisely aligned relative to each other. Since the tensioning together after a sequential positioning of the rotor disks occurs in a horizontal position, and since the welding, however, has to be performed in a vertical disposition of the rotor disks, i.e., with a horizontally disposed rotor axis, the tensioned-together rotor disks have to be moved from the first position with vertical axes into a second position with horizontally disposed axes. Since an axial tensioning together of the rotor disks alone cannot prevent shiftings and misalignments of the rotor disks toward each other with complete certainty, the rotor disks are furnished with the turn-outs, provided at the front faces of the hubs for the welding seams, and are further subjected to the following work processes.

The hubs with the rotor disks, provided with turnouts are furnished at their axial ends from the inside with match-fitting precise cylindrical turn-outs. The rotor disks are superposed on each other centered relative to each other, with the aid of annular disks fitting into the turn-outs, and possibly with the aid of a tube inserted into the annular disks, and the rotor disks are aligned relative to each other by rotation around the annular disks in circumferential direction.

The rotor disks are provisionally connected by welding points from the outside in the base of the grooves formed by the turn-outs and furnished for the welding seams or from the inside at positions accessible through the edge cut-outs of the annular disks.

After the rotor disks are provisionally connected, as described before, the annular disks can be removed, annular weld seams can be produced from the inside at the abutting positions of the neighboring hubs and the two outer annular disks, which are preferably selected to be of a stronger material with larger thickness as compared to the inner annular disks, are again inserted into the two outer rotor disks.

If not already done so, the tube is inserted into the annular disks where the tube extends and projects over the two ends of the unit formed by the provisionally interconnected rotor disks.

The unit, formed by the rotor disks, is placed with the ends of the tube onto two roller pairs of a welding plant. The unit, formed by the rotor disks, is slowly rotated under the welding apparatus by a drive device, furnished at said welding plant, where a gun of said welding apparatus reaches between the rotor disks up to the hubs or, respectively, into the welding seam groove.

The mutual centering of the rotor disks with the aid of the annular disks can be performed in various ways. For example, annular disks can be inserted in all cylindrical turn-outs of the hubs, and the rotor disks furnished with the annular disks can be slid onto a tube. The tube can later on also serve for carrying and supporting the unit comprising the rotor disks provisionally connected to each other.

The cylindrical turn-outs can, however, also be selected so small and narrow, and the annular disks can be selected so large and wide, that they engage into the turnouts of two neighboring rotor disks, thereby immediately and directly centering said neighboring rotor disks with respect to each other. The rotor disks are thereby placed on top of each other accompanied in each case by an intermediate positioning of an annular disk, and then the rotor disks are aligned relative to each other by rotation around the annular disks in circumferential direction.

It can be advantageous if the hubs of the rotor disks are connected to each other not only from the outside, but also from the inside with a welding seam, formed however of only a single layer or, respectively, only out of a few layers. For this purpose, the hubs are furnished with small turn-outs in addition to the cylindrical turn-outs. The small turn-outs are provided and disposed within the annular-shaped ribs.

In order to produce this inner welding seam, the annular disks are removed following the provisional connection of the rotor disks with the welding points applied at the base of the welding seam grooves. The inner annular disks are thereby destroyed and the annular welding seams are applied by hand.

The resulting improved rotor comprises at least two coaxial metallic disks, for example, each disk can constitute a steel casting having neighboring hubs, and at least one annular welded seam which bonds the hubs to each other.

Neighboring disks or portions affixed to hubs shall define an annular clearance which enables a welding implement or welding gun to reach the hubs by advancing substantially radially inwardly between the portions of the disks for making the welded seams.

The rotor can be provided with a rim which spacedly surrounds the respective hub. Also, the rims of the disks must define an annular clearance having a width such that a welding implement can pass through the clearance toward the hubs.

If the rotor is to be used in an impact crusher, every disk can include beater bar supports which are affixed to the periphery of the disk and the supporting surfaces of the supports are parallel to the common axis of the disks. The beater bar supports can be welded to the disks. The annular welded seams must be made prior to welding of the support to the disks because of an interfering of the beater bar supports with access to the hubs.

If the rims of the disks provide the mounting surfaces for the beater bars, such surfaces are prefabricated prior to welding the disks together by making the annular welded seams.

If the rotor is to have a composite hub of considerable length without increasing or unduly increasing the number of the disks, then the rotor can further comprise a distancing spacer element, for example, a sleeve or cylinder, which is disposed between the hubs of two neighboring disks and bonded to them by welded annular seams. The outer diameter of the distancing element can be equal or at least approximate the outer diameters of the hubs which are welded thereto.

The novel features which are considered as characteristic of the invention are set forth in particular in the appended claims. The improved rotor itself, however, both as to its construction and the mode of assembling the same, together with additional features and advantages thereof, will be best understood upon perusal of the following detailed description of certain presently preferred specific embodiments with reference to the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENTS

Figure 1:
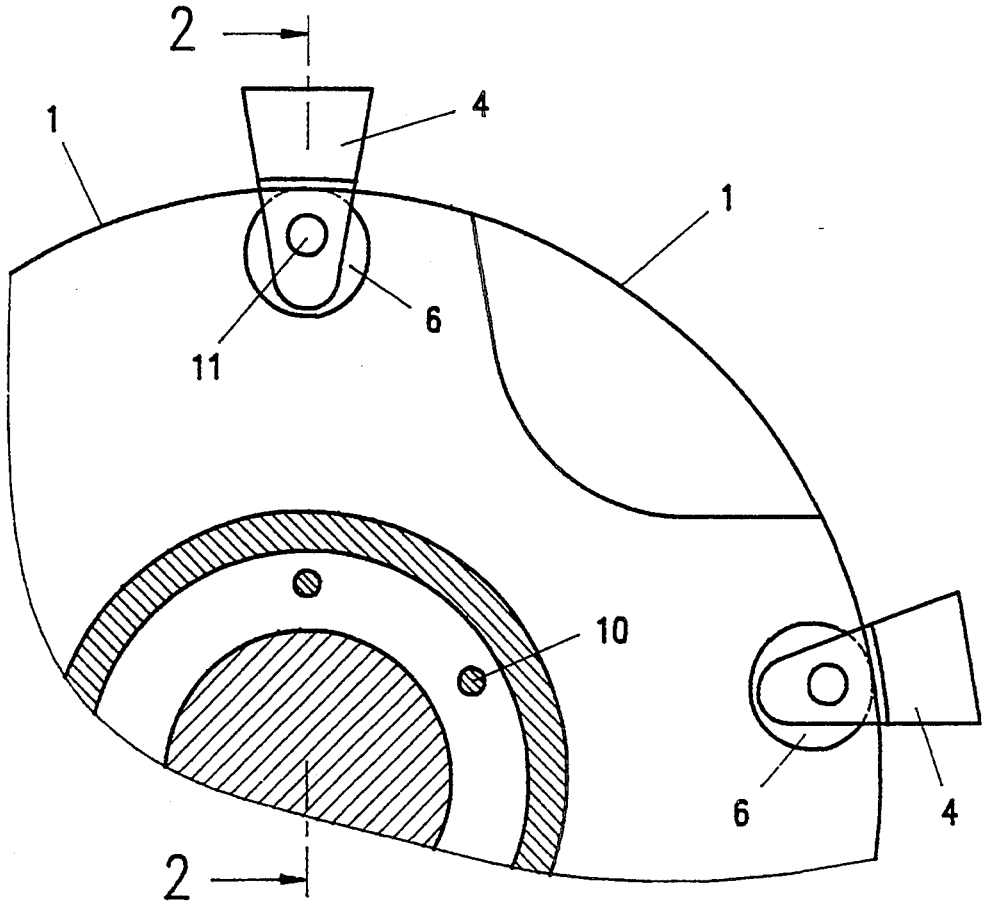
FIG. 1 is a fragmentary partly end elevational and partly transverse sectional view of a rotor which can be used in a hammer mill and embodies one form of the invention, the section being taken in the direction of arrows along section line 1—1 of FIG. 2.

According to the present invention, there is provided for a method for the production of a rotor comprising the following steps. Hubs 3 with the rotor disks 1, provided with turn-outs 17 for accepting a weld seam, are furnished at their axial ends from inside with match fitting precise cylindrical turn-outs 22 for accepting positioning elements. The rotor disks 1 are superposed onto each other and centered relative to each other with the aid of annular disks 20, 21, fitting into the turn-outs 22, and possibly with the aid of a pipe or tube 23 inserted into the annular disks 20, 21. The rotor disks 1 are aligned relative to each other by rotation around the annular disks 20, 21 in circumferential direction. The rotor disks 1 are provisionally connected by weld points 25 from the outside in the base of the weld seam grooves 16, formed by the turn-outs 17 and furnished for the weld seams 9, or from the inside at positions accessible through the edge cut-outs of the annular disks 21. The annular disks 21 can be removed after the rotor disks are provisionally connected. Annular welding seams 26 can be produced from the inside at an abutting position of the neighboring hubs 3. The two outer annular disks 20 can then be reinserted. The tube 23 is reinserted into the annular disks 20, 21 or, if the disks 21 are removed, into the annular disks 20. The tube 23 projects beyond the two ends of the unit formed by the provisionally interconnected rotor disks 1. The unit, formed by the rotor disks 1, is placed with the ends of the tube 23 onto two roller pairs 28 of a welding plant 27–30. The unit, formed by the rotor disks 1, is slowly rotated under the welding apparatus 30, by a drive device, furnished at said welding plant. A gun of said welding apparatus 30 reaches between the rotor disks 1 up to the hubs 3 or, respectively, into the weld seam groove 16.

The annular disks 20, 21 can be removed after the rotor disks are provisionally connected. Annular weld seams 26 can be produced from the inside at an abutting position of the neighboring hubs 3. The two outer annular disks 20 can then be reinserted.

The rotor disks 1 are advantageously heated in a preheating furnace to temperatures of between about 125° and 250° C. depending on the material composition of the rotor disks 1 before the provisional connection by the weld points 25. The unit comprised of the rotor disks 1 can be preheated to this temperature before the production of the weld seams 9 with the aid of flame tubes throwing flames. This temperature can be maintained during the welding process.

A rotor for impact or hammer mills includes a plurality of rotor disks 1. The rotor disks 1 are welded to each other and are made of cast steel. The rotor disks 1 exhibit widened hubs 3, contacting each other. The rotor disks 1 are connected to each other by annular weld seams at their hubs 3. The turn-outs 17, furnished for the weld seams 9 at the front faces of the hubs 3, extend from the outer edges over a substantial part of the radial thickness of the hubs. The weld seam grooves 16,, formed by the turn-outs 17 of neighboring rotor disks 1, are filled with welding material.

The weld seams 9 can comprise a plurality of layers of welding material disposed on top of each other in a radial outward direction.

Figure 2:
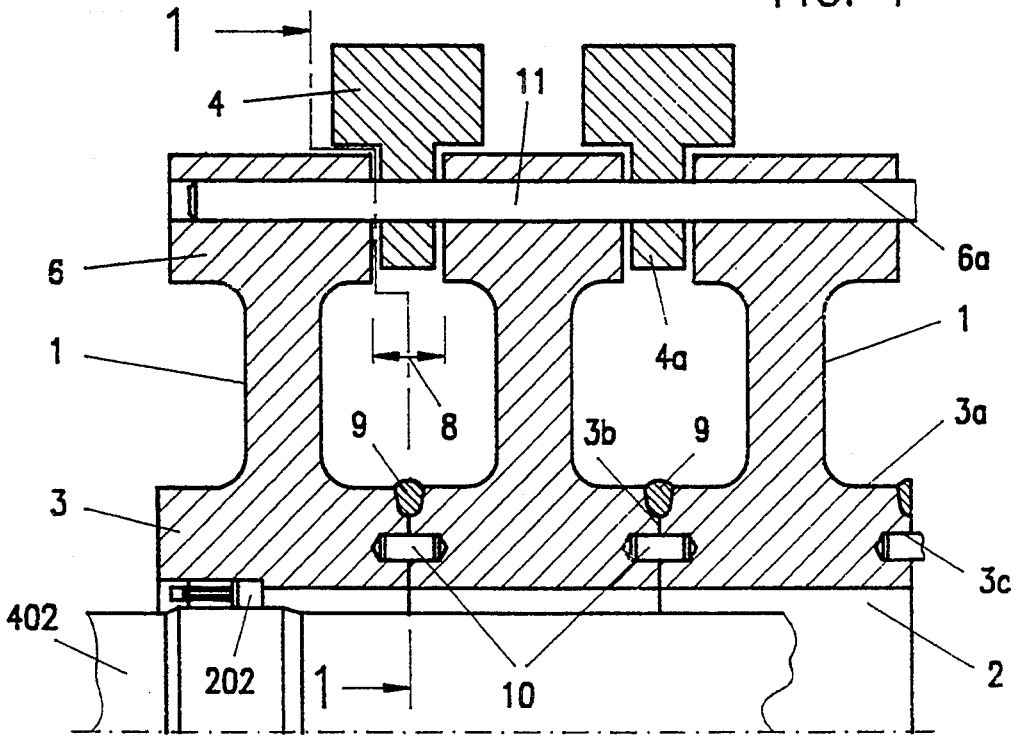
FIG. 2 is a fragmentary axial sectional view substantially as seen in the direction of arrows along section line 2—2 of FIG. 1.
Figure 4:
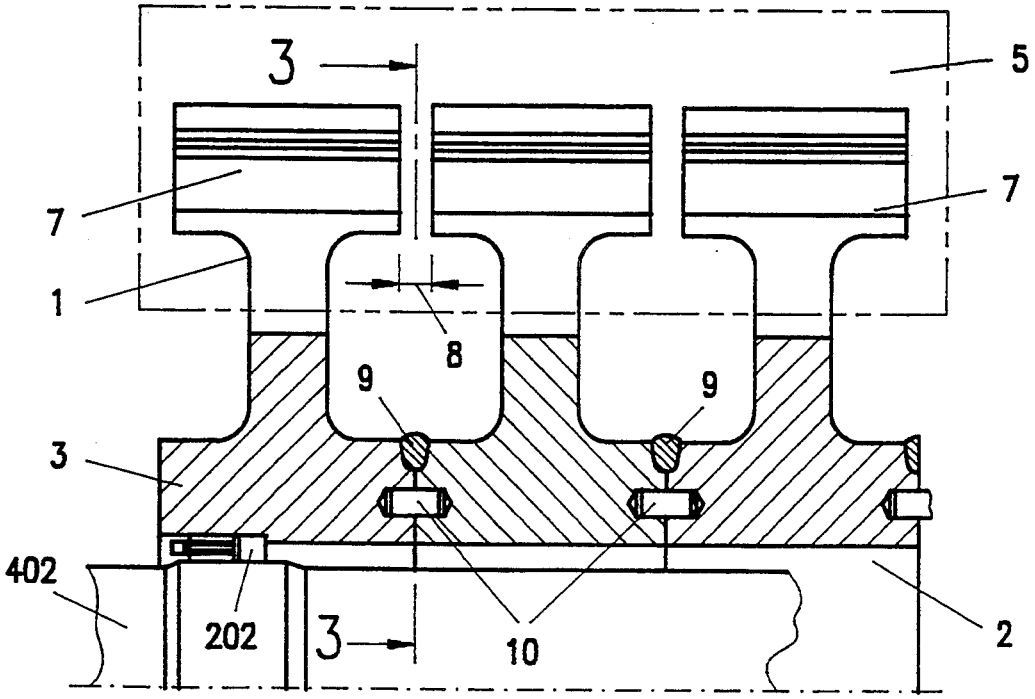
FIG. 4 is a fragmentary axial sectional view substantially as seen in the direction of arrows along section line 4—4 of FIG. 3.

The rotor which is shown in FIGS. 1 and 2 can be used with advantage in an otherwise standard hammer mill, for example, a hammer mill of the type produced and distributed by the assignee of the present application. This rotor comprises several coaxial metallic rotor disks 1. The coaxial metallic rotor disks 1 can be made of cast steel. Each of the metallic rotor disks 1 has a centrally located, axially extending bore or hole 2 for a rotor shaft 402 (FIG. 2) which is surrounded by suitable clamping devices. One such clamping device is shown at 202. The holes 2 are defined by hubs 3 which constitute the radially innermost portions of the respective disks 1 and have cylindrical or substantially cylindrical peripheral surfaces 3*a* of identical diameters. The adjoining end faces 3*b* of the hubs 3 are provided with aligned recesses 3*c*. The aligned recesses 3*c* can be furnished in the form of blind bores for insertion of portions of locating and centering bolts 10. The centering bolts prevent movements of neighboring hubs 3 relative to each other. A preferred embodiment of the present invention is discussed below in more detail with reference to FIGS. 11–14. The bores 3*c* and the bolts 10 according to FIGS. 2 and 4 are dispensed with in FIGS. 11–14, resulting in a simplified assembly.

The radially outermost portions or rims 6 of the disks 1 are provided with axially parallel aligned holes or bores 6*a* (FIG. 2) for elongated retaining bolts 11. The bolts 11 serve to couple the disks 1 supporting several aligned hammers 4 of any known design. The bores 6*a* are aligned in axial direction for all hubs forming a rotor. The width of radially outermost portions 6 is less than the length of the hubs 3 as measured in an axial direction of the rotor. The length of each of the three hubs 3 which are shown in FIG. 2 is preferably of equal value so that the neighboring portions 6 define relatively narrow clearances or gaps 8 for the radially inwardly extending portions 4*a* of the hammers 4. The portions 4*a* of the hammers 4 of each row of hammers are traversed by a retaining bolt 11. FIG. 1 shows that the bolts 11 are spaced apart from each other by approximately 90 angle degrees, i.e., that the rotor including the disks 1 can carry four rows of aligned hammers 4. FIG. 1 further shows that neighboring hubs 3 can be mechanically coupled to each other by several locating and centering bolts 10.

Figure 11:
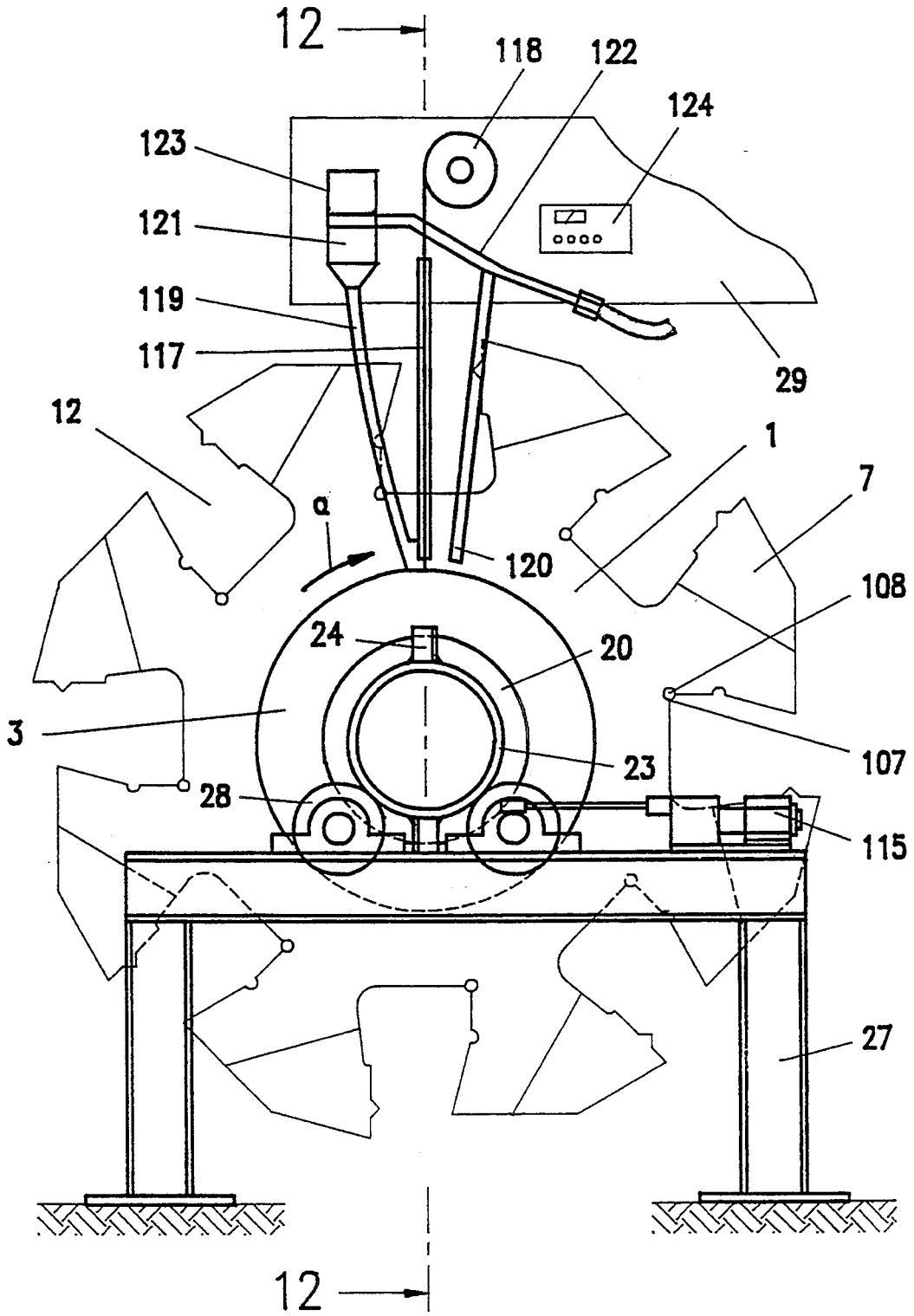
FIG. 11 is a side elevational view of a welding apparatus for welding together the hubs.
Figure 12:
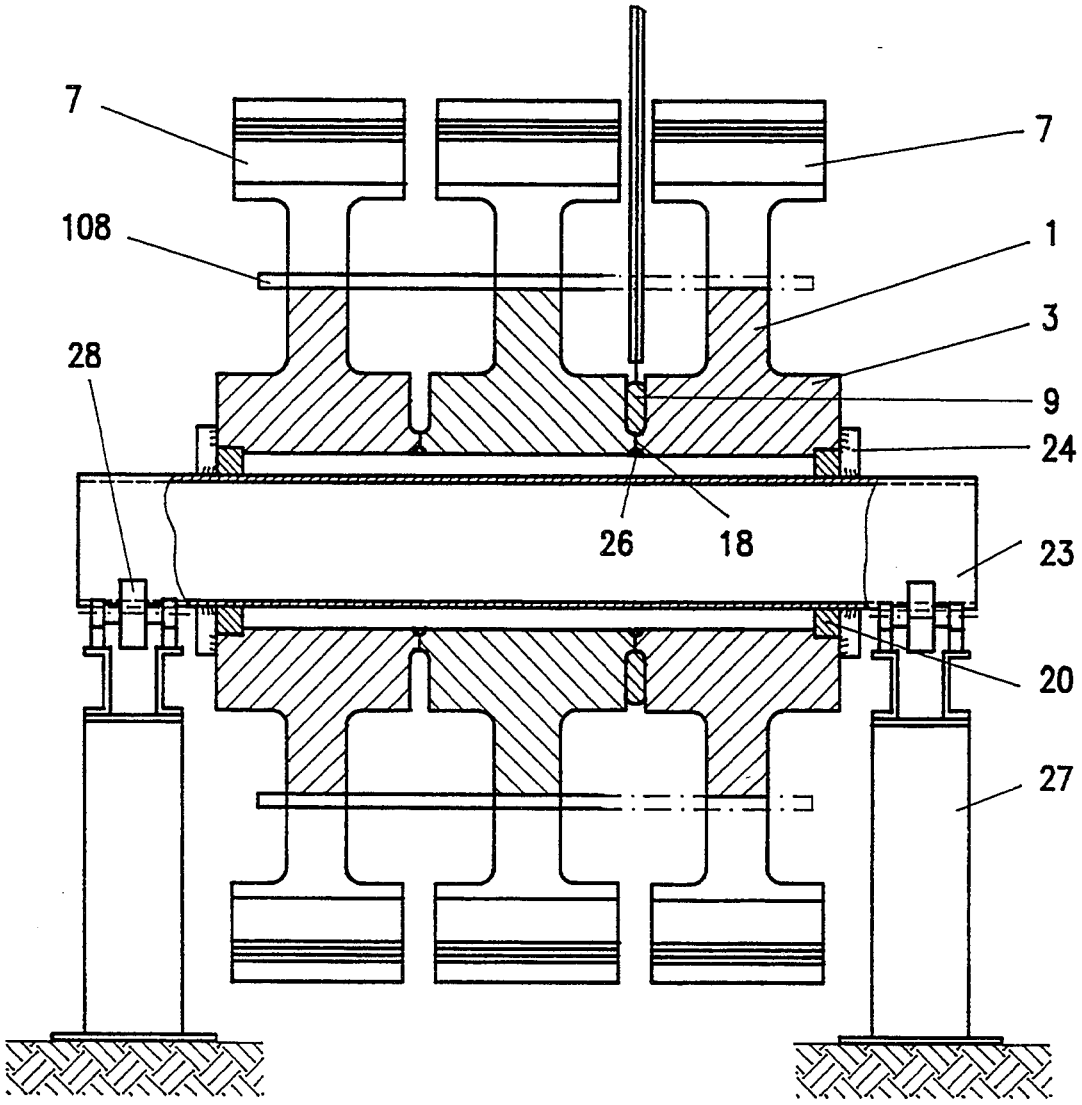
FIG. 12 is a sectional view of the welding apparatus according to FIG. 11 along section line 12—12.

While the embodiments of FIG. 1 and 2 employed centering bolts 10 for assembly of the configuration to be welded, preferred embodiments with a simplified centering system is shown in FIGS. 11 and 12. FIGS. 11 and 12 show a use of a pipe or of a rod 108 instead of centering bolts 10 shown in FIG. 1–4. The rod or pipe 108 is only employed as a temporary assembly aid for the welding operation in the inner corners 107 of the cutouts 12 which are bored and rounded for avoiding of notched cracks.

Figure 13:
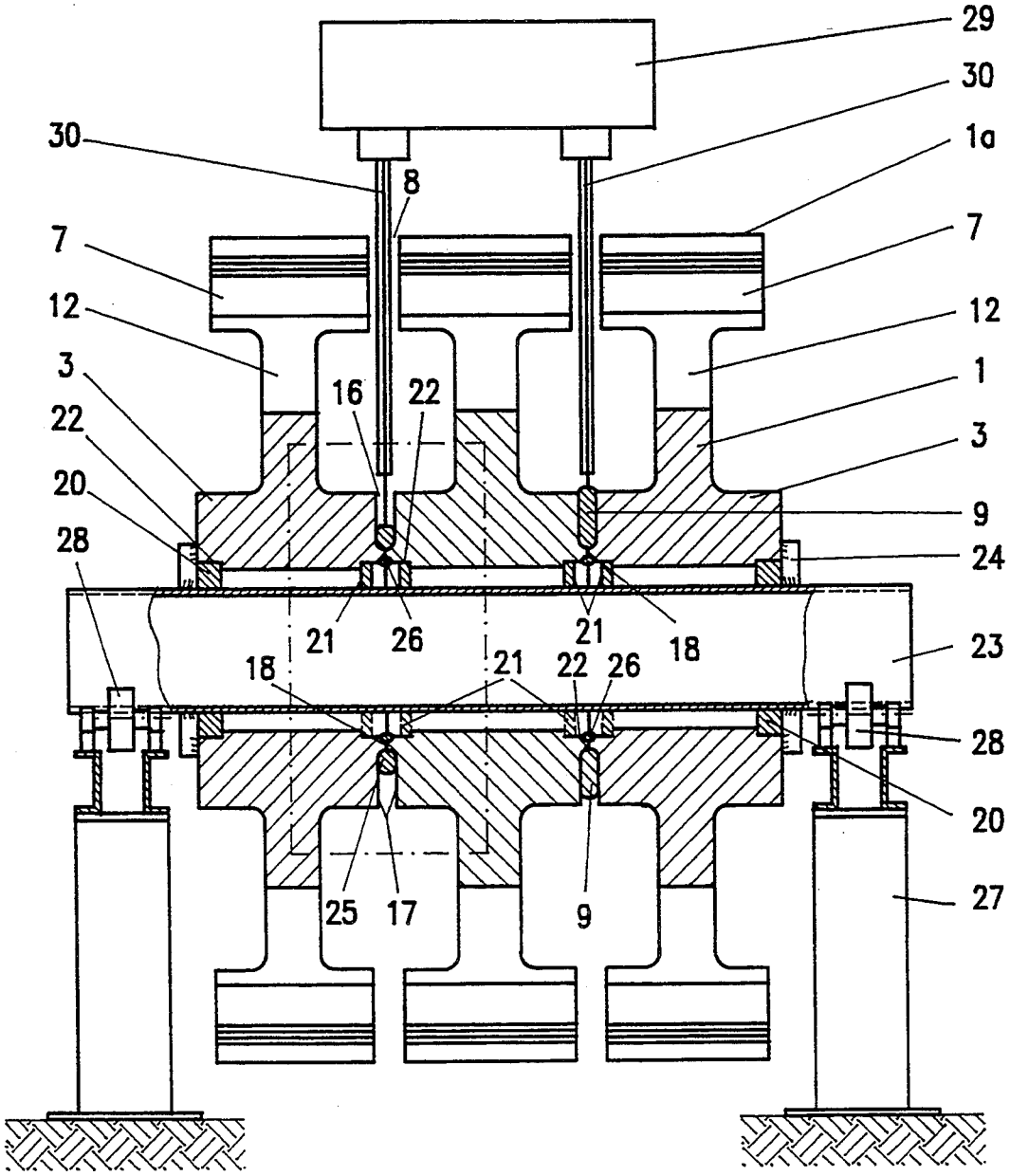
FIG. 13 shows a preferred alternative embodiment of the invention relative to the embodiment illustrated in FIG. 4.
Figure 14:
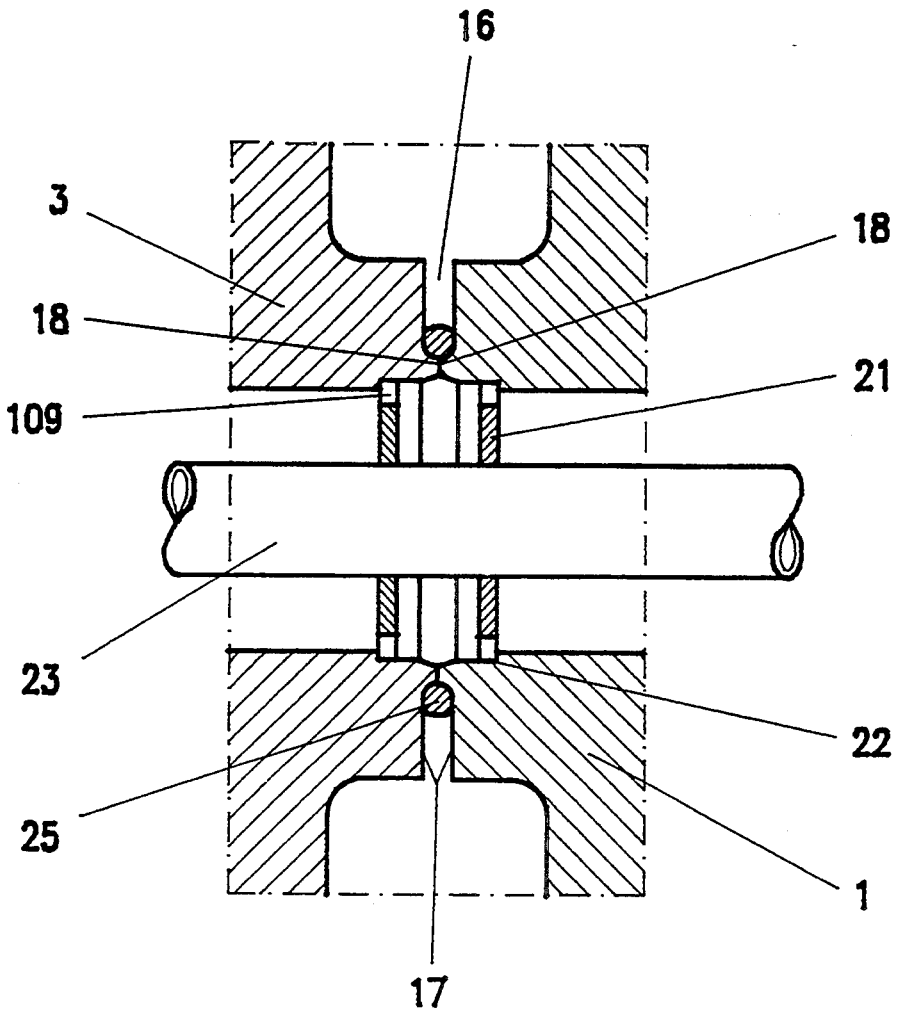
FIG. 14 is an in part sectional and in part side elevational view of the mounting assembly employed during the welding operation of FIG. 13 at an enlarged scale.

According to FIGS. 13 and 14, the rotor disks 1 are furnished at the front faces of the hubs 3 with turn-outs 17 for the formation of weld seam grooves 16. The turn-outs 17 extend from at least the radial middle of the hub 3 to the outer diameter of the hub 3 in the area to be welded together and preferably from at least an inner quarter in radial direction of the hub 3 to the outer diameter of the hub 3 in the area to be welded together. Annular ribs 18 are left by the turn-outs 17. The annular ribs 18 have front faces and the front faces are adjoining and abutting the respective front faces of the annular ribs 18 of neighboring rotor disks 1.

The cast rotor disks 1 are subjected to only minor premachining. The front faces of the hubs 3 are milled planar for the weld seams 9 and 26 while maintaining an annular rib 18, as illustrated in FIG. 12. The hubs 3 are furnished from the inside with seats formed by cylindrical turn-out 22 for preassembly, produced by milling or turning as illustrated in FIG. 14.

The auxiliary means required for the welding together of the rotor disks 1 are recited in the following in connection with the description of the work steps and processes.

The rotor disks 1 are aligned relative to each other with the annular ribs 18 of neighboring disks being disposed centrically on top of each other and aligned in a circumferential direction as shown in FIG. 13. The centering is performed with the aid of annular disks 20, 21, which annular disks 20, 21 are inserted into cylindrical turn-outs 22 of the hubs 3, and with the aid of a tube 23. The rotor disks 1 together with the annular disks 20, 21 are slid onto the tube 23 and are aligned relative to each other on the tube 23 by rotation in circumferential direction such that the edge cut-outs 12, furnished at the rotor disks 1, are aligned relative to each other.

Figure 3:
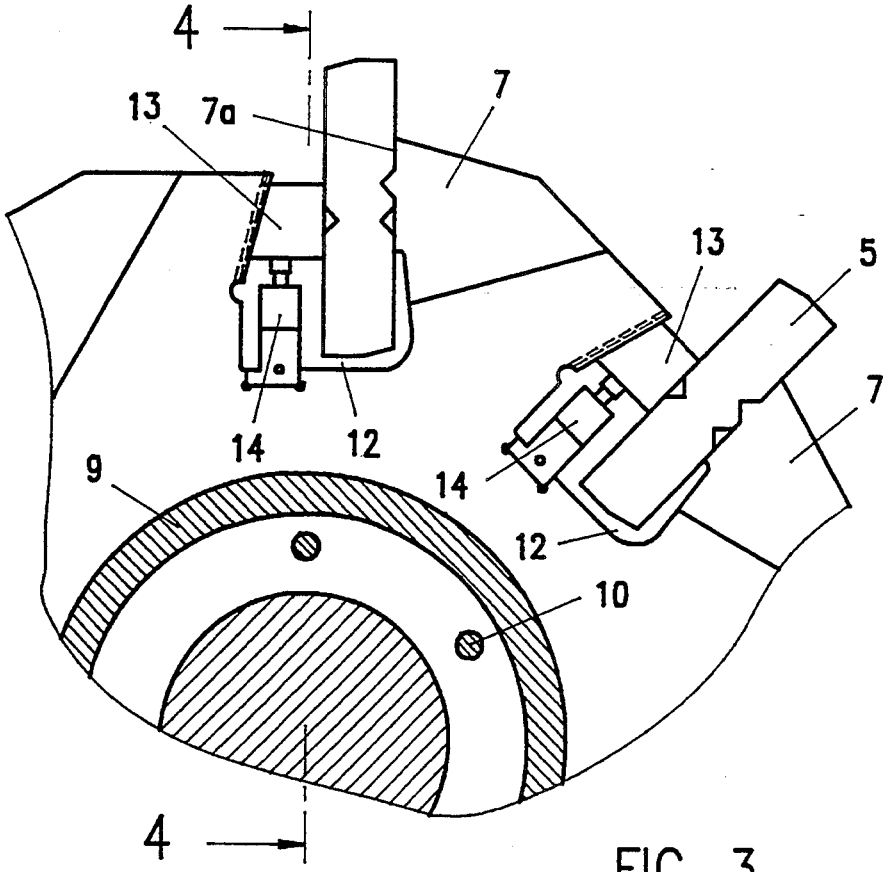
FIG. 3 is a partly end elevational and partly transverse sectional view of a rotor which can be used in an impact crusher and embodies another form of the invention, the section being taken in the direction of arrows along section line 3—3 of FIG. 4.
Figure 10:
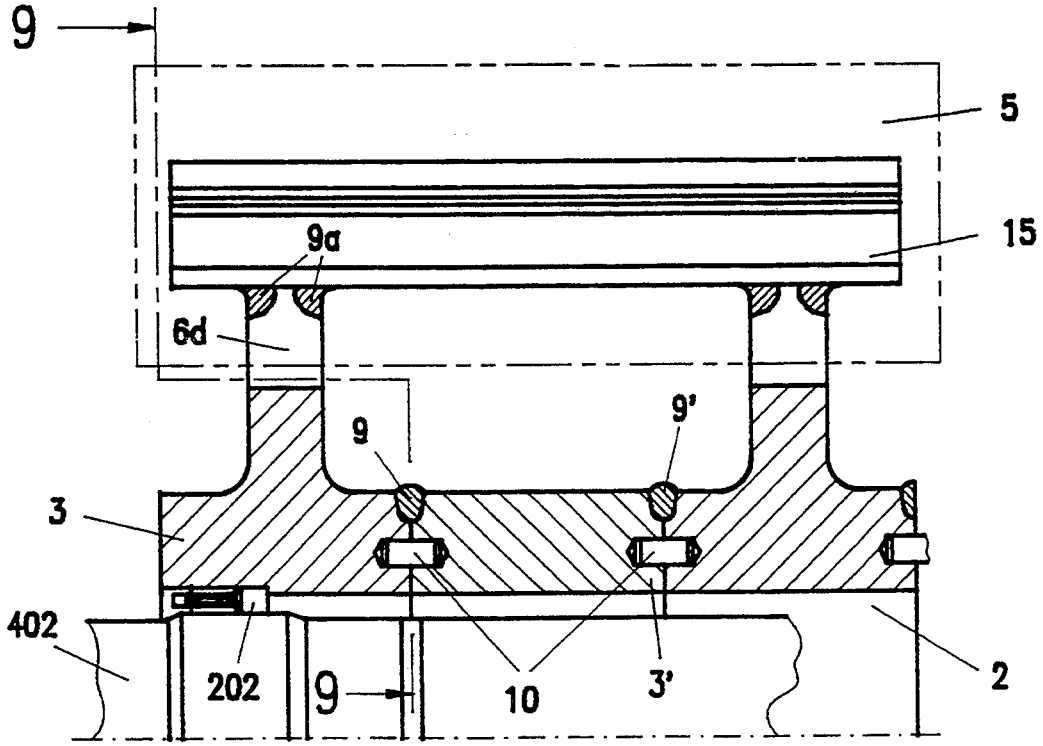
FIG. 10 is a fragmentary axial sectional view substantially as seen in the direction of arrows along section line 10—10 of FIG. 9.

Any surfaces which require a precision finish are preferably treated prior to making the welded seams. Thus, any surfaces on the radially outermost portions of the disks 1 or 1' (FIGS. 6, 8 and other FIGS.) can be precision finished prior to making the welded seams 9 and/or 9' (FIG. 10). For example, the surfaces *7a* (FIG. 3) of the radially outermost portions or rims 7, which are shown in FIGS. 3 and 4, will be finished prior to making the seams 9. The majority of surfaces on the disks 1 or 1' (FIGS. 6, 8) need not be machined with any high degree of precision or require no finishing at all. This contributes to a lower cost of the rotor. The holes or bore recesses *3c* and *6a* (FIG. 2) aligned for the centering bolts 10 and for the retaining bolts 11, if needed, can be formed with a very high degree of precision irrespective of the finish of other portions of the disks, and the making of such holes or bore recesses can be carried out at a relatively low cost by resorting to available machinery.

The axial width of each radially outermost portion 6 can be M–m, wherein M is the axial length of a hub 3 and m is the width of a clearance 8 (FIG. 2). The arrangement is preferably such that each hub 3 extends beyond both axial ends of the respective radially outermost portion 6 by m/2, i.e., by half the width of a clearance 8. This does not unduly weaken the radially outermost portions 6, i.e., such portions can reliably retain the bolts 11 and the hammers 4 or any other parts, for example, the beater bars 5 of FIG. 3, which are to be mounted on the rotor to carry out a comminuting action.

The width of the clearances 8 need not appreciably exceed 50 mm and can be less, for example from about 20 to 100 mm and preferably from about 30 to 50 mm. Such clearances afford access to the peripheral surfaces *3a* of the hubs 3 without unduly weakening the radially outermost portions 6 which constitute supports for the bolts 11 and hammers 4.

Then, the tube 23 (FIG. 13) is brought into a connection with the outer rotor disks 1 via follower dogs 24 and is fixed against relative rotation. In this state, the rotor disks 1 are provisionally connected to each other by weld points 25 (FIG. 13), applied at the base of the weld seam grooves 16.

If necessary, annular weld seams 26 (FIG. 13) can be applied at the inner butt impact seams of the hubs 3 within the annular ribs 18 after the provisional connection of the rotor disks 1 by the weld points 25 and after removal of the tube 23 and of the annular disks 20, 21, whereby the inner annular disks 21 are generally destroyed. The tube 23 can again be slid into the two outer annular disks 20 after reinsertion of same. This situation is illustrated in the drawing in FIGS. 12 and 13. The annular disks 21 (FIG. 13) are illustrated by dashed lines only, because they are already removed in principle in this mounting state assembly.

It is advantageous to preheat the rotor disks 1 prior to the provisional connecting to each other, for example, in a preheating furnace, and to preheat the overall rotor disks to be connected to each other prior to the application of the final weld seams to a temperature of between 125° to 250° and to maintain this temperature during the entire welding process, since the mass of the rotor disks to be connected to each other is large and therefore a heavy flow-off of heat occurs during welding. A heavy flow-off of heat can be prevented with the aid of flame throwers or flame tubes.

An advantageous modification of these operating processes results if the annular disks 21 are selected of such a width for the centering and the alignment in circumferential direction that they engage into the turn-outs 22 of two neighboring rotor disks 1. After a thus performed centering and after the performed alignment in circumferential direction, the rotor disks 1 are provisionally connected by preliminary weld points 26 from the inside in the region of the cut-out sections or turn-outs 22 furnished for this purpose for the annular disks 21. The hubs are connected from the inside through the cut-out sections or recesses 109 in the disks 21 by means of welding points. A full welding seam 26 is subsequently applied onto the area of said welding points. In addition to the recess 109 at the disks 21, the hubs 3 are beveled in addition, whereby a further turn-out 22 (FIG. 14) is generated for the weld seam 26. After removal of the annular disks 21, the previously recited annular weld seams 26 are applied at the inner butt impact seams of the hubs 3. The tube 23 is only then inserted in the outer annular disks 20, which annular disks have in the meantime been placed and positioned.

In accordance with a feature of the invention, neighboring hubs 3 are bonded to each other by annular welded seams 9 (FIG. 2) each of which can constitute a circumferentially complete ring. Such seams are formed by a welding implement, which can be caused to extend with a welding gun radially inwardly between the respective radially outermost portions 6, i.e., through the respective clearances 8 and to the peripheral surfaces *3a* of the hubs 3 which are to be bonded to each other by a welded seam 9. The welding operation is or can be carried out prior to mounting the hammers 4 by means of the retaining bolts 11, i.e., at a time when the clearances 8 are unobstructed all the way around the hubs 3. The disks 1 are mechanically coupled to each other by the bolts 10 according to the embodiments of FIGS. 1–10. The arrangement is preferably such that, once the working end of a welding implement is introduced through a clearance and assumes an operative position relative to the adjacent hubs 3, then the disks 1 are slowly turned about their common axis defined by the shaft 402 in order to enable the implement to make a welded seam 9. The procedure is then repeated as often as necessary to make another seam or seams 9. If necessary, the two outermost hubs 3 can be clamped and urged toward each other in the course of each welding or bonding operation, thereby ensuring that the axial positions of the hubs 3, which are being permanently bonded to each other, do not change while the welding implement is in the process of making a seam 9.

Prepared disks 21 (FIGS. 13 and 14) are employed for insertion into the hub 3 of the rotor disk 1, where the seat can be provided by a turn-out 22. The prepared disks 21 serve for centering the tube 23 providing a centering structure and the disks are placed onto the tube 23. The prepared disks 21 can be spot-welded into the outer weld seam recess of the turn-outs 22. In addition, rods 108 are placed into rounded sections 107 of the outer portions of the rotor disks 1 for providing an alignment aid between neighboring rotor disks 1 (FIG. 11). Then, the tube 23 and the disks 21 are removed again after the welding. For this purpose, the prepared disks 21 are cut through radially at the recesses 109 (FIG. 14). Afterwards the internal weld seams 26 are produced.

End disks 20 (FIG. 12) are reinserted into the turn-outs 22 of the end hubs 3, where a tube 23 is reinserted and plugged through the newly inserted end disks 20. Dog followers 24 are welded to the two ends of the tube 23 and to the rotor hubs.

The rotor disks 1, connected to each other, are pivoted together with the tube 23 into a horizontal axial position and are placed onto the welding apparatus. The welding apparatus includes a frame 27, which is furnished with two roller pairs 28. The tube 23 has its two ends protruding beyond the rotor disks 1, and rests with these ends on the roller pairs 28 of the frame 27. The roller pairs 28 can be driven with a gear motor 115. An extension arm 29, attached to the frame 27, extends above the unit formed by the provisionally interconnected rotor disks 1, disposed on the frame 27. The extension arm 29 can be adapted to the size of the workpiece.

The welding guns 30 are disposed at the extension arm 29. The welding guns 30 comprise in a conventional fashion in each case a feed tube 117 for the weld wire 118 for furnishing material for the seam, a feed tube 119 for the welding powder acting as a flux agent, and a draw-off flux pick-up pipe or exhaust 120 for excessive powder. The welding powder, furnished in the container 121, covers the welding mouth of the welding wire feed device. Excessive powder is removed via the pipe 120 with the aid of an injector pump 122, furnishing compressed air, and the excessive powder is returned to the container 121. The container 121 is furnished with an air filter 123. As illustrated in FIG. 13, these welding guns 30 extend through the annular clearances 8, disposed between the outer rims 7 of neighboring rotor disks 1, up to the weld seam grooves 16, present between the hubs 3 of the rotor disks 1, and possibly into the weld seam grooves 16. The welding guns 30 are adjustable with respect to their depth of insertion in between two rotor disks 1.

The unit comprising the rotor disks 1 is slowly rotated during the welding process, wherein weld layers in several or also many windings are superposed into the weld seam grooves 16, starting from the base of the weld seam grooves 16 until the weld seam grooves 16 are filled with welding material, and whilst the welding gun 30 is gradually and correspondingly raised up and out of the weld seam groove 16.

The arrow "a" in FIG. 11 indicates the direction of rotation for the welding process. The control unit for the wire feed and the rotation speed of the workpieces is designated with the reference numeral 124. The weld seam 9 comprises in case of large rotors about 60 levels for each connection disposed on top of each other. The complete welding work and the associated cost, however, are very small as compared to the production of rotors according to the state of the art. This small amnt of welding work is a substantial advantage provided by the present invention in addition to the possibility of providing a machine production on a production line.

The distance spacing between the rotor disks 1 outside of the hubs 3 is provided for the passage of the welding wire feed pipe 117 and of the coordinated, above recited pipes 119, 120, wherein the assembly of said pipes is designated overall as welding tongs or welding guns 30. The distance spacing is required for a machine production, as is shown in particular in FIG. 12.

The rods 108, illustrated in FIG. 12 in part with a solid line and in part with a dash-dotted line, have to be removed for the welding process to allow an unimpeded passage of the welding gun 30.

The welding equipment which is used to make the weld seam 9', the seams 9 and/or the seams **9*a* is a semi-automatic or fully automatic welding machine FIG. 11**.

The clearances 8 between the rims 7 of neighboring disks permit introduction of a welding implement or welding gun 30 which is used to make the welded seams 9 between neighboring hubs 3. Such welding operation is carried out prior to introduction of beater bars 5 (FIG. 3) into their respective cutouts 12, i.e. the welding operation is performed while the access to clearances 8 (FIG. 4) is unobstructed all the way around the disks 1.

Figure 5:
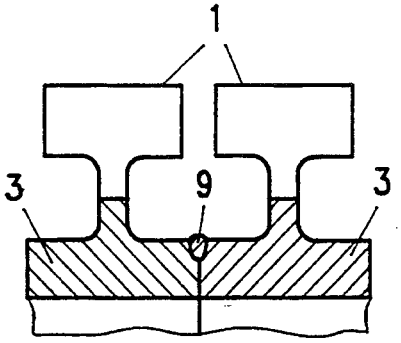
FIG. 5 is a fragmentary axial sectional view of a rotor having two disks with hubs of identical axial length.

FIG. 5 shows portions of two identical disks 1, i.e., disks having hubs 3 of identical axial length.

The welded seams 9 which are shown in FIG. 2 can be formed in a simultaneous operation by using a corresponding number of welding implements, each of which extends radially inwardly through one of the clearances 8 prior to mounting of the hammers 4 and prior to insertion of the retaining bolts 11, while the disks 1 slowly rotate as a unit around the axis of the tube 23.

Figure 6:
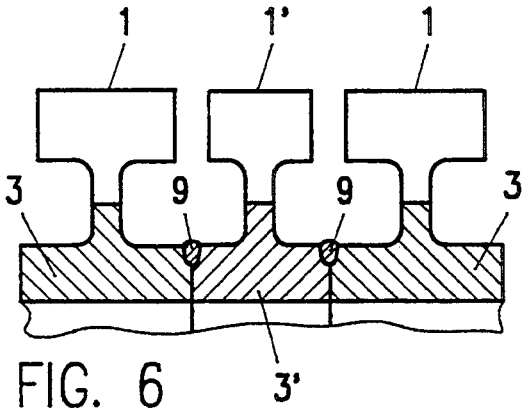
FIG. 6 is a fragmentary axial sectional view of a rotor with three disks, where two outer disks have longer hubs as compared to the hub of the center disk.

FIG. 6 shows portions of two identical outer disks 1 and a modified disk 1' between the disks 1. The hub 3' of the median disk 1' is shorter than the hubs 3 when viewed in the axial direction of the rotor. An advantage of the provision of disks having different axial lengths includes a possibility to assemble rotors where the axial length of the rotor disks is not a whole multiple of the axial length of a hub 3 or 3'.

Figure 7:
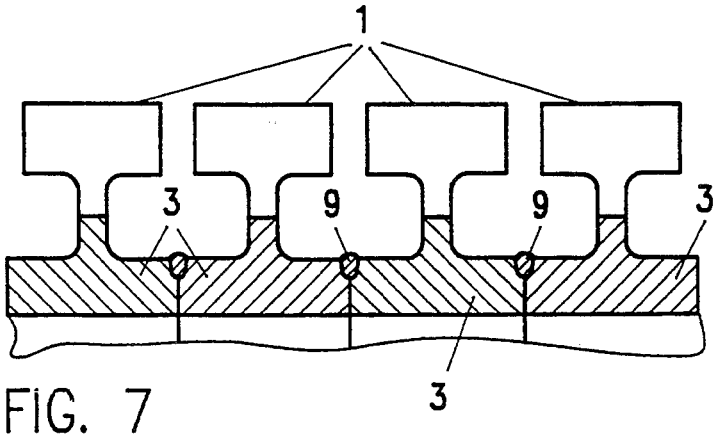
FIG. 7 is a fragmentary axial sectional view of a rotor with four disks with each disk having a hub of identical axial length.
Figure 8:
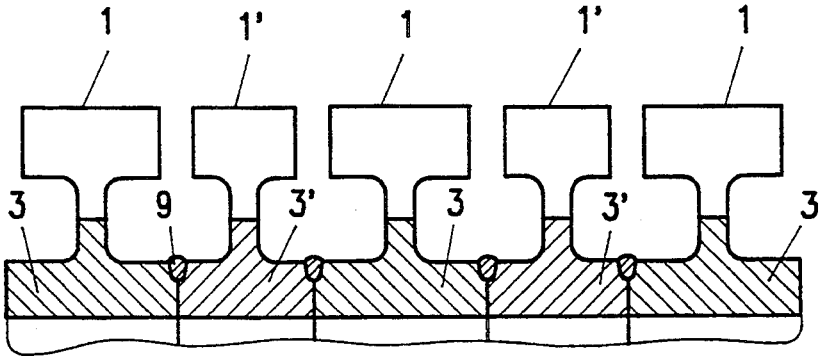
FIG. 8 is a fragmentary axial sectional view of a rotor having five disks, three of which with longer hubs and two with shorter hubs alternating.

The rotor of FIG. 7 comprises four identical disks 1, and the rotor of FIG. 8 comprises five disks, namely three disks 1 and two disks 1', which disks 1' alternate with the disks 1.

It is clear that the improved rotor can comprise more than five disks and/or that the disks of a rotor can include one or more disks with hubs having a length m1, one or more disks having a length m2, one or more disks having a length m3, and so forth.

The axial length of the hubs exceeds the axial width of the respective rims, specifically by the width of the clearance. The arrangement may be such that each hub extends axially beyond both axial ends of the respective rim by approximately half the width of the clearance between the rims.

The axial length of the hub of one of the disks can be greater than the axial length of the hub of another disk. This renders it possible to assemble a composite rotor having a desired axial length, for example, by assembling two or more disks having hubs of identical axial length or by assembling two or more disks with hubs having in part identical and in part different or only different axial lengths.

By maintaining a supply of disks having different axial lengths, a manufacturer of improved rotors can satisfy a range of different customer orders with a relatively small stock of disks.

Figure 9:
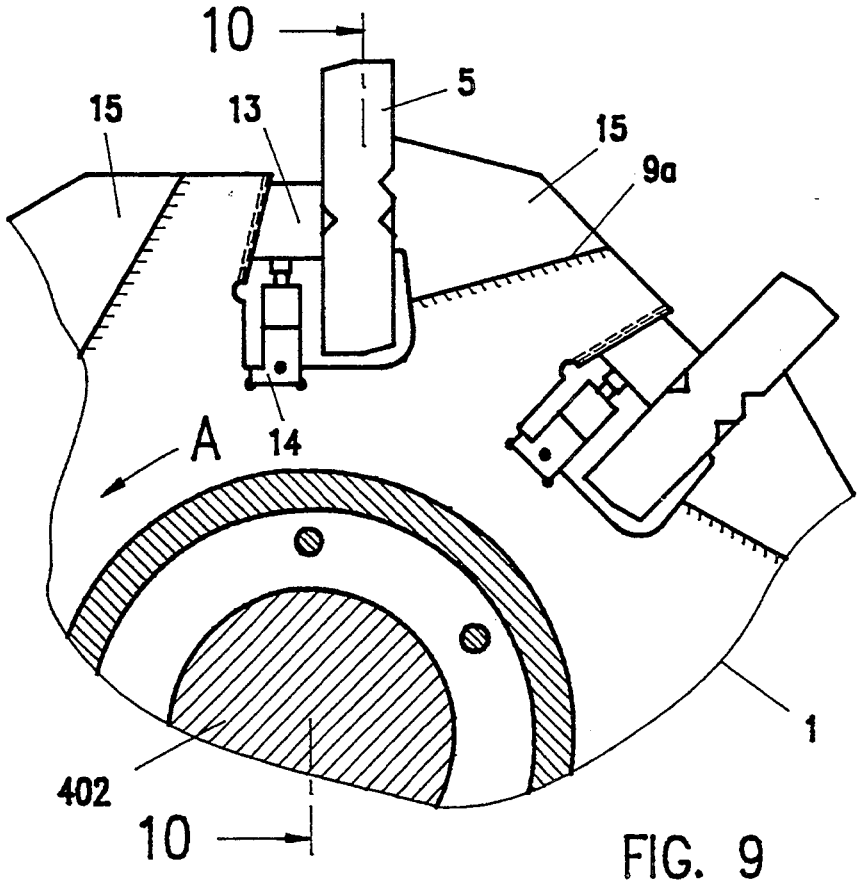
FIG. 9 is a fragmentary partly end elevational and partly transverse sectional view of a rotor for use in a relatively small impact crusher, the section being taken in the direction of arrows substantially along section line 9—9 of FIG. 10.

FIGS. 9 and 10 show a portion of a rotor which can be used in a relatively small impact crusher. The rotor of FIGS. 9 and 10 constitutes a modification of the rotor which is shown in FIGS. 3 and 4.

The radially outermost portions 6*d* of the disks 1, which are shown in FIGS. 9 and 10, differ from the radially outermost portions 7 shown in FIGS. 3 and 4 in that they are narrower, as seen in the axial direction of the rotor, and are welded, as at 9*a*, to axially parallel supports 15 for beater bars 5. Each support 15 can constitute an elongated one-piece metallic member which is bonded to the radially outermost portions 6*d* of the disks 1 by a pair of welded seams 9*a* (FIG. 9). Such welded seams 9*a* are made subsequent to making of the welded seams 9 and 9' at the peripheries of the hubs 3. The two hubs 3 which are shown in FIG. 10 are welded to the respective ends of a hollow cylindrical or sleeve-like integral extension or metallic distancing element 3'. This distancing element 3' can be said to constitute an axial extension of the left-hand or right-hand hub 3, i.e., the left-hand welded seam 9 of FIG. 10 can be said to bond the left-hand hub 3 to the distancing element 3' of the right-hand hub 3, or the right-hand welded seam 9' can be said to bond the right-hand hub 3 to the distancing element 3' of the left-hand hub 3.

The tube 23 and the annular disks 20 and 21 are withdrawn and removed from the thus produced rotor body after the welding and the rotor body is furnished with a shaft 402 and such parts as beater bars.

After the welding process, the weld seam grooves 16 are full with the welding material forming the weld seams 9.

After the welding, the disks 20 and 21, the tube 23, and the dog followers 24 are removed and the rotor is furnished with a shaft 402 and the remaining parts, such as, for example, the beater bars 5 as illustrated in FIG. 9.

When the making of the seams 9 is completed, as illustrated in FIG. 2, the assembly of the rotor is resumed or continued, i.e., the hammers 4 are connected to the radially outermost portions 6 of the disks 1 by means of the retaining bolts 11.

An important advantage of the improved rotor is that the welded seams 9 are remote from the hammers 4, i.e., that the welded seams 9 are not in direct contact with the material which is being comminuted in an impact crusher embodying the rotor of FIGS. 1 and 2.

Another important advantage of the improved rotor is that the peripheral surfaces 3*a* of the hubs 3 can be reached by a suitable welding implement in spite of the presence of radially outermost portions 6. This is due to the aforediscussed dimensioning of the hubs 3 and of the radially outermost portions 6, i.e., the radially outermost portions 6 define annular clearances 8 through which a welding implement can extend to reach the locations for the making of welded seams 9 in spite of the fact that the peripheral surfaces 3*a* of the hubs 3 are much closer to the axis of the assembled rotor than the peripheral surfaces of the radially outermost portions 6. As mentioned above, heretofore known rotors were constructed in such a way that the radially outermost portions of the disks are welded to each other by resorting to hand-held equipment.

The improved rotor merely requires a single annular welded seam 9 for each pair of neighboring hubs 3 in contrast to the construction of German Patent document No. 1,808,322. Moreover, the permanent and welded connections between neighboring end faces 3*b* of the hubs 3 are rugged and highly reliable. Therefore, it is not necessary to mount the improved rotor on a shaft 402 (FIG. 2) which extends all the way from the left-hand axial end of the left-hand hub 3, as seen in FIG. 2, i.e., it suffices to slip only a portion of the composite hub onto a portion of the shaft 402. Such mounting exhibits the advantage that it is not necessary to machine the entire surface bonding the central opening of the composite hub with a high degree of precision, i.e., it suffices to precision finish the internal surfaces of the two outermost hubs 3 or to precision finish only portions of the internal surfaces of these hubs.

The rotor of FIGS. 9 and 10 resembles rotors of the type disclosed, for example, in U.S. Pat. No. 3,531,055 in several respects. This patent describes a rotor with support beams for beater bars.

The supports 15 are located behind the respective beater bars 5. The arrow A of FIG. 9 indicates the direction of rotation of the rotor disposed in a relatively small impact crusher.

Further important advantages of the improved rotor are its simplicity and low cost. Thus, each rotor disk 1 is a relatively simple and inexpensive component, and each such disk can be permanently bonded to the adjacent disk by a single annular welded seam 9.

FIGS. 3 and 4 show a portion of a modified rotor which can be used in an impact crusher, e.g., an otherwise standard impact crusher of the type produced and distributed by the assignee of the present application. All such parts of the rotor of FIGS. 3 and 4, which are identical with or clearly analogous to corresponding parts of the rotor of FIGS. 1 and 2, are denoted by similar reference characters. A main difference between FIGS. 1/2 and 3/4 includes that the rims 7 of the disks 1, which are shown in FIGS. 3 and 4, are designed to support elongated axially parallel beater bars 5. The disks 1 with rims 7 are distinguished by cutouts 12 which are open at the peripheries of the disks 1 in order to permit insertion of a beater bar 5 into each of a series of aligned cutouts. Once inserted, the beater bars 5 are fixedly held by wedges 13 which are biased by thrust elements 14 to prevent radially outward movements of the beater bars along the prefabricated surfaces 7*a* of the radially outermost portions 7. The surfaces 7*a* exhibit locking elements for fixing a defined relative position.

All in all, the improved rotor exhibits a number of important and desirable characteristics including compactness, low cost, stability, ruggedness and convenient access to parts which require frequent inspection or replacement.

It will be understood that each of the elements described above, or two or more together, may also find a useful application in other types of rotors differing from the types described above.

While the invention has been illustrated and described as embodied in the context of a rotor for impact crushers or hammer mills, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A rotor for impact or hammer mills, comprising a unit including a plurality of rotor disks, wherein the rotor disks are made of cast steel, wherein groove sections are furnished at the front faces of the hubs, and wherein the groove sections extend from the outer edges over a substantial part of the radial thickness of the hubs for an accommodation of weld seams, wherein the rotor disks are axially aligned relative to one axis, wherein the rotor disks are sequentially disposed along said axis, wherein the hubs of neighboring rotor disks contact each other at annular sections representing the longest extension of the rotor disks in said axial direction, wherein the groove sections at neighboring rotor disks form weld seam grooves, wherein the weld seam grooves are filled with annular weld seams, and wherein the rotor disks are connected to each other by said annular weld seams attaching neighboring hubs to each other.

2. The rotor according to claim 1, wherein the weld seams comprise several layers of welded metal disposed in a radial outward direction on top of each other, and wherein the rotor disks exhibit a larger width in an area adjacent to the welding.

3. The rotor according to claim 1, wherein a first annular weld seam is disposed at the inside bore of said hubs for connecting said hubs, wherein a second annular weld seam is disposed between two neighboring disks, and wherein the first annular weld seam and the second annular weld seam are separated by abutting rotor disks.

4. The rotor of claim 1, wherein at least about half of the abutting area of two neighboring rotor disks is provided by a weld seam.

5. A rotor for impact or hammer mills, including several rotor disks, where the rotor disks are welded to each other and are made of cast steel, where the rotor disks exhibit hubs providing a widest section of the rotor disks in an axial direction, and wherein neighboring disks are contacting each other at said widest section, and where the rotor disks are connected to each other by annular weld seams at their hubs, wherein turn-outs (17), furnished for the weld seams (9) at the front faces of the hubs (3), extend from the outer edges over a substantial part of the radial thickness of the hubs, and wherein the weld seam grooves (16), formed by the turn-outs of neighboring rotor disks, are filled with welding material.

6. The rotor according to claim 5, wherein the weld seams (9) comprise a plurality of layers of welding material disposed on top of each other in a radial outward direction.

* * * * *